United States Patent [19]

Kranich, II

[11] Patent Number: 4,562,316

[45] Date of Patent: Dec. 31, 1985

[54] HIGH VOLTAGE LINEAR TAP CHANGER

[75] Inventor: Neil J. Kranich, II, West Allis, Wis.

[73] Assignee: ASEA Electric, Inc., Waukesha, Wis.

[21] Appl. No.: 618,265

[22] Filed: Jun. 7, 1984

[51] Int. Cl.[4] ..... H01H 15/16

[52] U.S. Cl. ..... 200/16 D; 200/11 TC; 200/153 PA; 200/279

[58] Field of Search ..... 200/11 B, 11 C, 11 TC, 200/16 F, 16 R, 16 A, 17 B, 153 PA, 16 D, 161, 237–292; 74/436; 339/276 R

[56] References Cited

U.S. PATENT DOCUMENTS

| | | | |
|---|---|---|---|
| 2,085,707 | 6/1937 | Shore | 200/279 X |
| 3,290,471 | 12/1966 | Gerardin et al. | 200/16 C X |
| 3,673,364 | 6/1972 | Klein | 200/16 F |
| 3,742,162 | 6/1973 | Wasemann | 200/61.62 |
| 3,818,747 | 6/1974 | Van Riemsdijk | 74/436 |
| 3,824,355 | 7/1974 | Norman et al. | 200/16 F |
| 3,924,085 | 12/1975 | Stone | 200/61.62 |
| 3,967,088 | 6/1976 | Horiuchi | 219/10.55 C |
| 4,101,750 | 7/1978 | Doner | 219/10.55 C |
| 4,160,885 | 7/1979 | Ellicott et al. | 200/1 |
| 4,220,332 | 9/1980 | Ritchie et al. | 339/17 LM |
| 4,233,478 | 11/1980 | Stahl et al. | 200/51.09 |
| 4,303,962 | 12/1981 | Wolber et al. | 361/399 |
| 4,351,995 | 9/1982 | Inoue et al. | 200/159 A |

*Primary Examiner*—A. D. Pellinen
*Assistant Examiner*—Morris Ginsburg
*Attorney, Agent, or Firm*—Ronald E. Barry

[57] ABSTRACT

A high voltage electrical switching apparatus including a base formed from a pair of flat dielectric plates supported in a spaced relation, a number of elongate elliptically shaped contacts positioned between the plates at equally spaced intervals, a dielectric bar mounted for linear motion between the plates, a pair of electrically conductive plates mounted on opposite sides of the bar, each conductive plate including a pair of louvered contacts spaced a distance apart sufficient to electrically interconnect two of the elongate contacts, and a Geneva drive assembly for moving the bar in steps of equal distance.

11 Claims, 10 Drawing Figures

HIGH VOLTAGE LINEAR TAP CHANGER

BACKGROUND OF THE INVENTION

This invention relates to high voltage electrical switching apparatus and, more specifically, to high current, de-energized tap selecting switches used in power transformers. These transformers traditionally include tap changing mechanisms for allowing minor adjustments to the primary winding ratio. These adjustments are required to compensate for line voltage variations related to the physical distance from the point of power generation. The adjustments are generally made at the time of installation and remain unchanged as long as the power transformer remains at the sight.

The design of tap changing mechanisms is difficult due to the requirement for accurate contact positioning on all three phases of the transformer from a single manual operating mechanism located outside of the transformer. The switch contact surface area must be sufficient to prevent excessive temperature rise during all phases of operation with sufficient contact pressure to prevent arcing and/or welding during short circuit conditions.

The operating mechanism for tap changers of this type consisted of an externally mounted handle which would be rotated through a predetermined angular distance to obtain the desired tap setting. The problem with such an operating mechanism is largely due to the fact that the mechanism used to move the contacts to the desired position was also used externally to lock the operating handle, thus free play in the coupling apparatus could prevent full displacement of the tap changing switch even though externally the operating handle indicated full displacement, and was locked in position.

The contact design for this type of a switching apparatus must be capable of obtaining full current carrying capacity and at the same time maintaining sufficient contact pressure to withstand both normal and short circuit current stresses without welding or overheating. This has been generally achieved by a complex set of contact plates, springs, pivots and magnetic clamps which were used for the sliding bridge contact with cylindrical fixed contacts supported by insulating members. The problem with this arrangement is that only two lines of electrical contact can be guaranteed on each fixed contact regardless of size. Maximum current carrying capacity was thus limited to such line contact. In addition, the failure of a single spring could result in loss of contact pressure sufficient to cause failure of the switch as well as the transformer.

The fixed contacts in these systems were generally cylindrical in shape with a hollow end designed for the insertion of a stranded cable. The end was then crimped to secure the cable therein and to make a good electrical connection. This type of a contact is limited to one cable which severely limits the current carrying capacity in the system. The cabling had to be crimped into the contact prior to assembling the contact on the contact holder due to the limited clearance between the contacts. Because of the location of the switch, the cabling had to be bent to a right angle very close to the crimped area which often resulted in broken strands within the cable. This again limits or reduces the current carrying capacity of the contact and can produce high partial discharge levels resulting in dielectric failure. Precrimping of the cable assemblies requires extra cable length or where the cabling is short additional cabling length which would produce another potential problem area.

SUMMARY OF THE INVENTION

The tap changer according to the present invention is designed to provide all of the above requirements while maintaining exceptionally high quality in a low volume production operation. The tap changer provides positive and accurate contact positioning regardless of any free play or inaccuracies in the manual operating mechanism or coupling devices. The contact surface area has been increased as well as the amount of surface pressure. The tap changer can be manufactured from readily available stock materials on common machine shop equipment.

This has been achieved by utilizing a linear, Geneva gear, operating mechanism in the switch, separate from the external operating handle, which accurately indexes the contact assemblies and locks them in position regardless of free play in the coupling apparatus. This is very important in this type of switch assembly since misalignment of the contact assemblies can cause overheating and or arcing of the contacts, both of which may cause catastrophic failure of the switch and transformer.

The bridge contact assembly is simple in construction in that the bridge contacts include a plurality of contact louvers that provide a minimum of three contact points for each louver. The contact louvers provide superior contact area and are reliable over the previous design concepts. The louvers also provide increased contact pressure during periods of short circuit current. In addition, the proposed contact assembly reduces the number of complex machine parts and the labor required to produce them while increasing current carrying capacity and reliability.

The fixed contacts are provided with large flat contact surfaces and can accommodate more than one cable with a right or left hand takeoff from the fixed contact. This has been achieved by using a separate crimp connector which bolts to the fixed contact allowing the cable to be custom cut for every application. The combination of the flat fixed contact and separate crimp connector adds to the versatility and reliability and economy of the overall installation while adding the ability of the switch to be easily changed should it become necessary.

IN THE DRAWINGS

DESCRIPTION OF THE INVENTION

Figure 1:
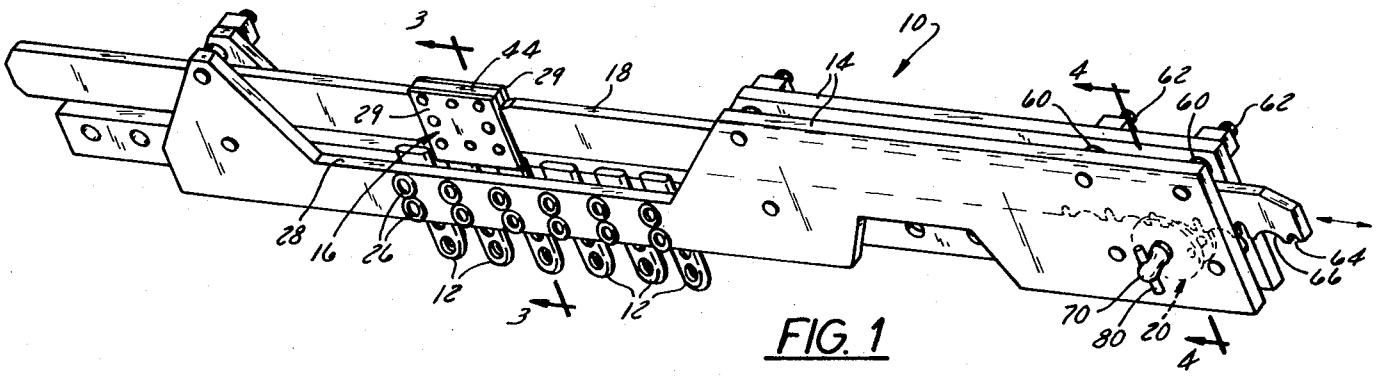
FIG. 1 is a perspective view of the high voltage tap changer according to the present invention.

The tap changer 10 is of the linear type, having a number of fixed contacts 12 mounted in a parallel spaced relation between a pair of plates 14 and sliding contacts 16 mounted on a slide bar 18. the bar 18 is mounted for reciprocal motion between the plates 14. The sliding contacts 16 are arranged to selectively interconnect two of the fixed contacts 12 at any one time. The bar 18 is moved in a step-by-step manner by means of a Geneva gear drive mechanism 20 mounted at one end of the plates 14. The tap changer 10 is generally mounted inside of the transformer tank on one of the fixed stringers and is operated by means of a manual drive mechanism attached to the outside of the tank wall passing through a sealed opening for engagement with the Geneva drive mechanism.

Figure 2:
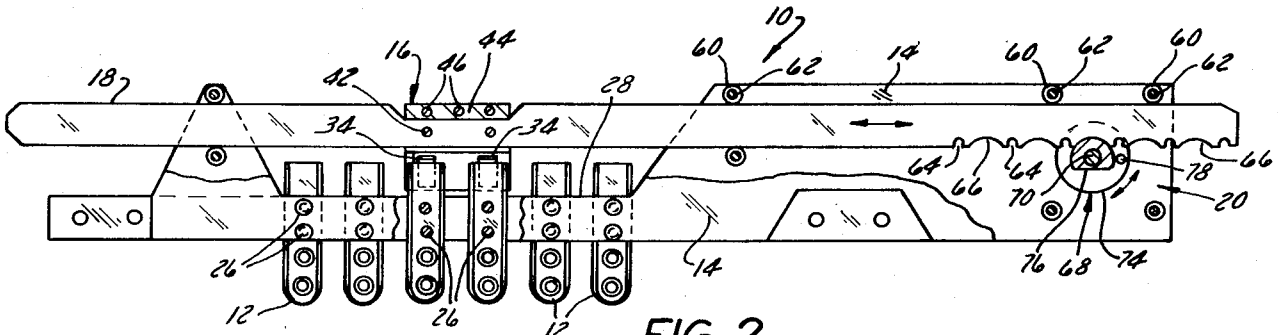
FIG. 2 is a side elevation view of the tap changer with portions broken away to show the mounting arrangement.
Figure 6:
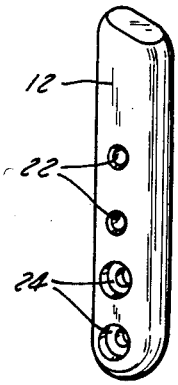
FIG. 6 is a perspective view of one of the fixed current carrying contacts.

The fixed contact 12, as seen in FIG. 6, is formed from a solid copper bar having two mounting holes 22 centrally located in the bar and two countersunk bores 24 at one end of the bar. The opposite end of the bar is in the form of an ellipse having a flat surface on each side and a curved surface on each edge. The fixed contacts 12 are supported between the plates 14 by means of rivets 26. Referring to FIG. 2, it should be noted that the fixed contacts 12 are spaced at equal intervals in a notch 28 provided between the plates.

Figure 3:
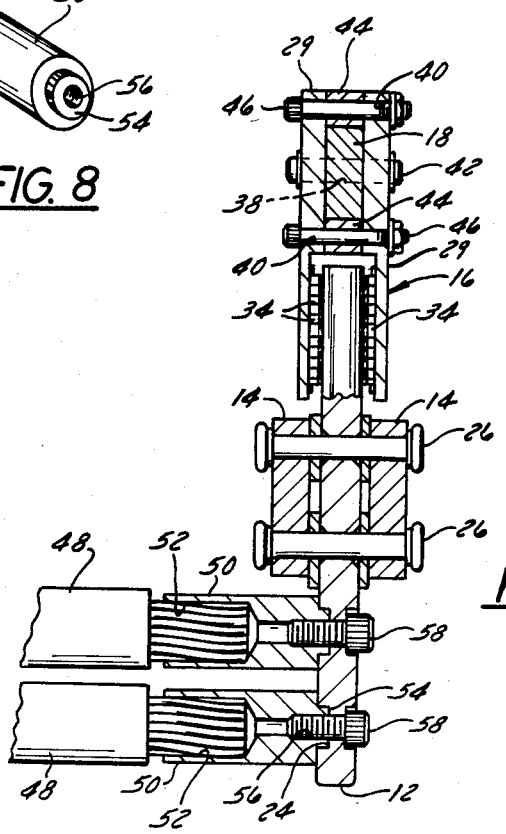
FIG. 3 is a view taken on line 3—3 of FIG. 1 showing the current carrying contacts in engagement with the fixed contacts.
Figure 7:
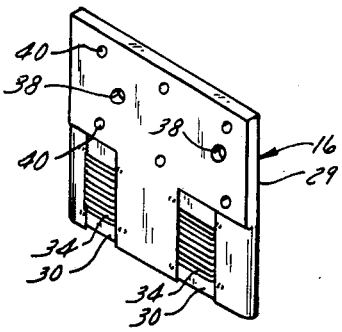
FIG. 7 is a perspective view of one of the sliding current carrying contacts.

Each of the sliding contacts 16, as seen in FIG. 7, is formed from a copper plate 29. Each plate has a pair of silver plated louvered contact sections 34 located in slots 30 on one surface which are located a distance apart equal to the distance between two of the fixed copper contacts 12. A pair of mounting holes 38 are provided on the upper portion of the plate 16. A set of holes 40 is provided in each plate for securing the conductive spacers 44 between the plates 29. The sliding contacts 16 are mounted on the bar 18 by means of a pair of pins 42 as seen in FIG. 3. The contact plates are electrically connected to each other by means of the conductive spacers 44 which are located at the top and bottom of the bar 18 and are retained therein by means of screws 46 which pass through holes 40.

It should be noted that the sliding contacts 16 are spaced a distance apart greater than the thickness of the fixed contacts 12. Electrical connection of the sliding contact 16 to the fixed contacts 12 is provided by means of the louvered contacts 34 which protrude beyond the sliding contacts 16 to a dimension slightly less than the thickness of the fixed contacts 12. Proper deflection of the louvered contacts 34 is maintained by the spacing between the plates 16 provided by the conductive spacers 44. Current flow is across the width of each louver and each louver provides a minimum of three contact points. Proper contact pressure is maintained by the springing action of each louver when deflected. The louvered contacts 34 also provide a wiping action which is sufficient to remove any oxidation or other foreign matter which may accumulate on the fixed contacts 12. Very high currents due to short circuit or pulse loading of the transformer create electrical forces on each individual contact louver which serves to increase contact pressure under these conditions.

Figure 8:
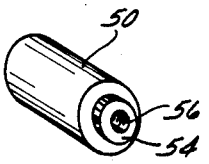
FIG. 8 is a perspective view of one of the crimp connectors.

Electrical connection of the cables 48 to the fixed contacts 12 is provided by means of crimp connectors 50 as seen in FIG. 8. Each crimp connector being in the form of a cylindrical member having a blind bore 52 at one end and a tapered boss 54 at the other end. A threaded bore 56 is provided in the boss 54. The crimp connectors are mounted on the fixed copper contact by inserting the boss 54 into the recess provided at the entrance to the holes 24. The boss is drawn into the recess by means of bolts 58. The tapered boss provides a force fit in the counterbore or recess to assure positive electrical communication between the crimp connector and the fixed copper contact.

Figure 4:
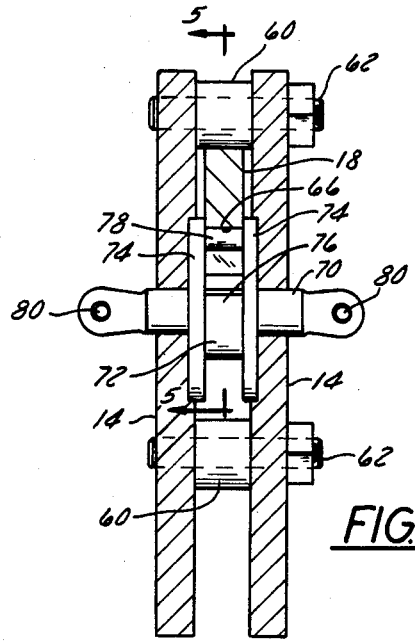
FIG. 4 is a view taken on line 4—4 of FIG. 1 showing the drive mechanism.
Figure 5:
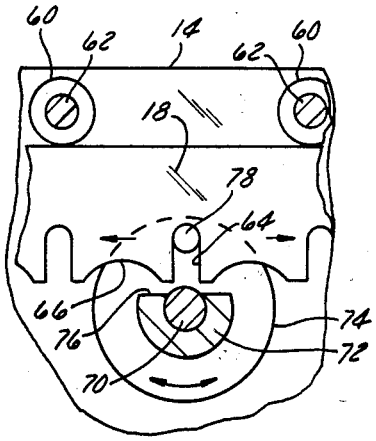
FIG. 5 is a view taken on line 5—5 of FIG. 4 showing the Geneva drive wheel.
Figure 9:
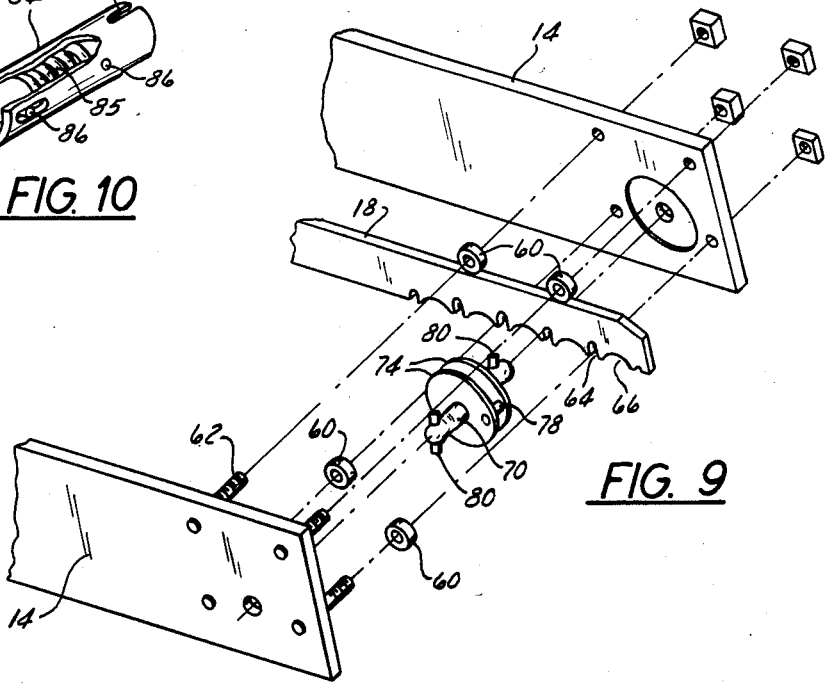
FIG. 9 is a perspective view of the Geneva drive assembly.

The sliding contacts 16 are moved in a step-by-step manner by means of the Geneva drive mechanism 20 as seen in FIGS. 4, 5 and 9. In this regard, the bar 18 is mounted for reciprocal motion between the plates 14. The bar 18 is supported by spacers 60 provided on threaded fiber rods 62. The bar 18 is, thus, free to move linearly between the plates 14. The bar 18 includes a number of slots 64 along one edge which are separated by arcuate surfaces 66. The bar is moved by means of a Geneva drive wheel 68 which includes a drive shaft 70 having a hub 72 mounted in the center of the shaft between a pair of circular plates 74. The hub 72 includes a semicircular section having a radius corresponding to the radius of the arcuate section 66 and a flat section 76. A drive pin 78 is mounted between the circular plates 74 on the same side of the hub as the flat section. The shaft 70 is rotated by means of drive pins 80 provided at each end of the shaft 70. On rotation of the wheel 68 in either direction, the pin 78 will move into one of the slots 64 pushing the bar 18 in the same direction of motion as the pin 78 until the pin emerges from the slot and is returned to the start position. The flat section 76 on the hub 72 allows for the unrestricted movement of the bar 18 and the semicircular section of hub 72 rotates into engagement with the arcuate surfaces 66 when the pin 78 is returned to the start position to lock the bar 18 in a fixed position.

Figure 10:
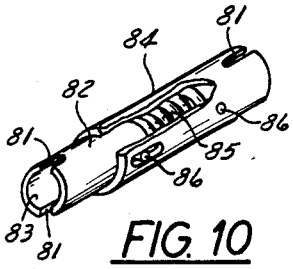
FIG. 10 is a view of a drive rod used to transfer motion from one phase assembly to the next.

Referring to FIG. 10, a drive rod is shown which is used to connect the drive pins 80 from one switch assembly to the adjacent switch assembly. The drive rod includes an outer cylindrical housing 84 and an innner cylindrical housing 82. The outer housing 84 includes a pair of slots 81 on the end which will cooperate with the pins 80 on the ends of the shafts 70. Slots 81 are also provided in the inner cylindrical member 82 which also cooperate with the pins 80 on the adjacent switch assembly. The inner cylindrical member 82 is biased by a means of a spring 85 which is seated on a pin 86 in the outer cylindrical member 84. The inner cylindrical member 82 is limited in its movement by means of a pin 86 which is provided in the slot in the side of the outer cylindrical member 84.

I claim:

1. A high voltage tap changer comprising a pair of flat plates, a number of fixed current carrying contacts mounted between said plates in an equally spaced relation, said current carrying contacts having flat surfaces on each side, a bar supported for reciprocal motion between said plates, a pair of sliding current carrying contacts mounted on said bar, said sliding current carrying contacts being spaced apart a distance greater than the thickness of said fixed contacts and being of a length to interconnect two fixed contacts at any one time, a louvered contact means mounted on said current carrying contacts in an opposing relation and being spaced apart a distance less than the thickness of said fixed contacts, and means for moving said bar in a step-by-step manner, said moving means including a Geneva drive mechanism for moving said bar one step in each revolution of the drive mechanism.

2. The tap changer according to claim 1 wherein said moving means includes a number of slots spaced equal distances apart on said bar and said Geneva drive mechanism includes a wheel having a pin positioned to engage one slot in each revolution of the drive mechanisms.

3. The tap changer according to claim 1 wherein each of said fixed contacts comprises an elongate copper bar having a flat contact surface on each side of one end of the bar and a number of openings at the other end, a crimp connector positioned in each of said openings and being adapted to be connected to the conductive member of a high voltage cable.

4. The tap changer according to claim 1 wherein said current carrying contacts each comprise a flat plate, and said louvered contact means including a pair of louvered sections on one side of said current carrying contacts, said plates being positioned with said louvered sections in opposing relation to provide frictional contact between said louvered sections and the flat contact surface on said fixed contacts on movement into engagement with said fixed contacts.

5. A high voltage tap changer comprising a pair of plates formed from dielectric material, means for supporting said plates in a parallel spaced relation, a number of flat electrical contacts supported in a spaced relation between said plates, a bar formed from a dielectric material and means for supporting said bar for reciprocal motion between said plates, an electrically conductive plate mounted on each side of said bar in opposing relation, said conductive plates being spaced apart a distance greater than the thickness of said contacts, a pair of louvered contacts mounted on each conductive plate in an opposed relation to a corresponding pair of louvered contacts mounted on the other conductive plate to provide an interference fit between the louvered contacts and said electrical contacts on moving said plates over said contacts, and drive means for moving said bar in steps of equal length in both directions of motion.

6. The tap changer according to claim 5 wherein said drive means comprises a Geneva drive mechanism having a drive wheel mounted between said dielectric plates and having a signal drive pin located at the outer circumference of said drive wheel, and a plurality of slots in said bar located a predetermined distance apart to allow for said pin to move into one slot in each direction of rotation of said drive wheel.

7. The tap changer according to claim 5 or 6 wherein each of said electrical contacts comprise an elongate copper bar having a flat contact surface on each side of one end of the bar, and a number of openings in the flat contact surface at the other end, a crimp connector supported in each of said openings and being adapted to be connected to a high voltage cable.

8. A linear type tap changer for a power transformer comprising a number of flat electrically conductive members adapted to be connected to the transformer, dielectric means for supporting said conductive members in a linear relation at equally spaced intervals, linearly movable contact means mounted on said dielectric supporting means and including louvered contacts for movement into electrical engagement with said electrically conductive members, and means for moving said contact means in a step by step manner through steps of equal distance whereby said contact means will positively engage two electrical contact members after each step of motion.

9. The tap changer according to claim 8 wherein said moving means includes a Geneva drive mechanism mounted on said support means and being operatively connected to said linearly movable contact means.

10. The tap changer according to claim 9 wherein said drive mechanism includes a Geneva drive wheel having a pin located on the wheel in a position to operatively engage said movable contact means in each revolution of the drive wheel.

11. The tap changer according to claim 8 including a tubular crimp connector mounted on a flat side of each of said electrically conductive members for connecting the tap changer to the transformer.

* * * * *